United States Patent [19]

Otagawa et al.

[11] Patent Number: 4,982,486

[45] Date of Patent: Jan. 8, 1991

[54] METHOD FOR PRODUCTION OF MOLDING FOR VEHICLES

[75] Inventors: Atsushi Otagawa, Urawa; Toshio Okabe, Ageo, both of Japan

[73] Assignees: Honda Giken Kogyo Kabushiki Kaisha; Sankei Giken Kogyo Kabushiki Kaisha, both of Tokyo, Japan

[21] Appl. No.: 416,305

[22] Filed: Oct. 3, 1989

[30] Foreign Application Priority Data

Oct. 7, 1988 [JP] Japan ..... 63-253594

[51] Int. Cl.[5] ..... B23P 25/00

[52] U.S. Cl. ..... 29/527.4; 264/177.2

[58] Field of Search ..... 29/527.4; 264/177.1, 264/177.16, 177.2; 52/716

[56] References Cited

U.S. PATENT DOCUMENTS 2,609,780 9/1952 Whitebeck ..... 29/527.4

FOREIGN PATENT DOCUMENTS 8031 1/1985 Japan ..... 29/527.4

*Primary Examiner*—P. W. Echols
*Assistant Examiner*—David P. Bryant
*Attorney, Agent, or Firm*—Armstrong, Nikaido, Marmelstein, Kubovcik & Murray

[57] ABSTRACT

A method for manufacturing a molding for vehicles which comprises the steps of forming a stainless steel web into a main body having a predetermined cross section; adhesively attaching members of soft synthetic resin longitudinally to the main body with a portion of the main body projecting beyond the synthetic resin members and the adhesive spaced inwardly from the edge of the synthetic resin members adjacent such projecting portion of the main body and subjecting the main body with the adhesive and resin members thereon to chromium-plating, thereby chromium-plating the exposed surface of the stainless steel main body.

1 Claim, 3 Drawing Sheets

METHOD FOR PRODUCTION OF MOLDING FOR VEHICLES

BACKGROUND OF THE INVENTION 1. (a) Field of the Invention

This invention relates to a method for manufacturing a molding with brightening property, to be mounted on the periphery of a window pane, at the front, rear or side part of the body of vehicles, in particular, automotive vehicles.

2. (b) Description of Prior Art

The molding to be mounted on the periphery of the window pane of an automobile, for example, is difficult to be manufactured in a continuous length and, even if possible, manufacturing of such molding would, inevitably, increase production cost. Because of this, it has been the practice, in the case of manufacturing a molding to be mounted on and around the window pane of a 4-door type sedan M as shown in FIG. 8 of the accompanying drawing to this application, to manufacture the front door molding assembling a rectilinear front door molding A, a front sash molding B having a slightly curved portion and rectilinear portions connected before and after the curved portion, with a front corner C for joining the moldings A and B. The rear door molding is manufactured by assembling a rectilinear rear door molding D, a rear sash molding E, and a rear pillar molding F, with corner parts, at both ends, thereof, joining each of the moldings D and E.

In order to obtain the corrosion-resistant property and the brightening property, the abovementioned door molding A, the front sash molding B, the rear door molding D and the rear sash molding E are produced by first roll-forming stainless steel web into the main body for the molding having a required cross-sectional shape, then passing the thus shaped main body of stainless steel web through an extrusion molding machine to integrally provide an edge part, protruded part and connecting parts of a soft synthetic resin material (usually, vinyl chloride) in the longitudinal direction of the main body of stainless steel web; and, finally, cutting the lengthy main body into pieces of required length.

The front sash molding B is bent by passing such section through a bender. Because the front corner molding C has a small radius of curvature, the rear pillar molding F has different width between its upper part and lower part and its overall configuration is complicated because of corner parts on both upper and lower ends thereof, the main bodies of these component parts cannot be manufactured by roll-forming and bending, alone.

In view of the foregoing, the conventional method of manufacturing component parts for such the molding has been such that the main bodies of the front corner C and the rear pillar molding F are manufactured by die-casting of zinc, or injection-molding of rigid synthetic resin such as ABS resin, and so forth. The thus shaped main bodies are plated with chromium; and, thereafter, the edge part and the protruded part made of a soft synthetic resin, or other elastomeric materials, are attached onto predetermined positions of the main bodies.

Because conventional molding for the vehicles are of such construction as mentioned above, there inevitably takes place a phenomenon such that the component parts of the moldings, as joined together, assume different brightening colors of stainless steel and chromium-plating, from one to the other, due to difference in configuration of the moldings, depending on the position of their attachment onto the vehicle body, which might give delicate difference in color tone, and, hence, unsightly appearance to the viewers, even though such component parts assume the same metallic brightening colors.

With a view to avoiding such unsightliness, there has been practiced a method of treatment, in which the portion of the molding made of stainless steel main body, which is exposed to the outside, is subjected to buffing so as to bring the stainless steel color closer to the chromium color. Even with this treatment, however, there is a limit to adjustment of the color tone. In addition, there is an apprehension such that the shaped part of the soft synthetic resin might be impaired by the machining. Hence, no satisfactory result can be obtained.

As another method, the roll-formed main body of the stainless-steel web is plated with chromium, onto which the edge member and the protruded member of soft synthetic resin, or other elastomeric materials, formed in advance by the extrusion-molding and then cut into a required length, are attached onto predetermined positions of the stainless steel main body with an adhesive agent. This method, however, is still disadvantageous in that not only the adhesion of the edge member, etc. is time-taking and troublesome, but also the edge member and protruded member, as adhered onto the main body of the molding, might become sinuous, or leave a clearance between the main body and the edging member, etc. with the consequence that the molding is in poor finish and the final products are irregular and non-uniform in quality.

SUMMARY OF THE INVENTION

It is therefore an object of the present invention to provide a method for manufacturing the molding for the vehicles, which is capable of solving the abovementioned problems.

With a view to attaining the abovementioned object of the present invention, there is provided a method for manufacturing a molding for vehicles, which comprises steps of: forming a stainless steel web into a main body for said molding having a predetermined cross-section; then attaching on said molding main body, as an integral part thereof, edge members, protruded members. and so forth, of a soft synthetic resin formed by extrusion-molding, in the longitudinal direction of the stainless steel main body; and subjecting said molding main body and said edge member, etc. to chromium-plating in a manner to cause a coating layer of chromium to adhere onto an exposed portion of the stainless steel main body, which constitutes its outside when the molding is mounted on the vehicle body.

The foregoing object, other objects, as well as the specific construction and function of the present invention, will become more apparent and understandable from the following detailed description of a preferred embodiment thereof, when read in conJunction with the accompanying drawing.

BRIEF DESCRIPTION OF THE ACCOMPANYING DRAWING

Figure 5:
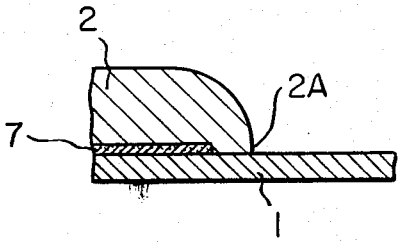
Figure 6:
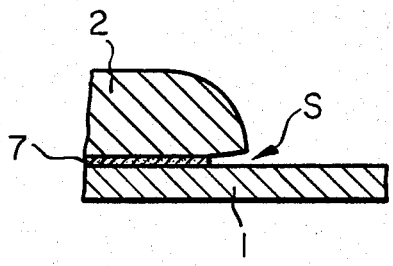
Figure 7:
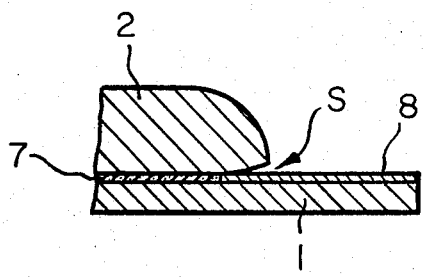
Figure 8:
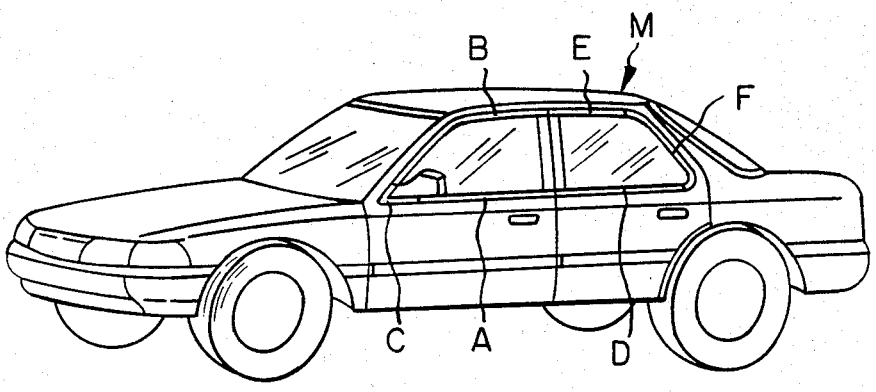

FIGS. 5, 6 and 7 are respectively enlarged cross-sectional views in the vicinity of the parting portion of the lip part, for the purpose of explaining the process steps in accordance with one preferred embodiment of the method of manufacturing the molding in accordance with the present invention; and FIG. 8 is a general view of an automotive vehicle of a 4-door sedan type wherein the conventional molding is mounted.

DETAILED DESCRIPTION OF PREFERRED EMBODIMENT

As may be understood from the foregoing description, the method of the present invention is lo subJect the molding obtained by integrally providing, in advance, the edge member, protruded member, etc. of a soft synthetic resin on the main body of stainless steel web having a predetermined cross-sectional shape (i.e., a composite shaped article of stainless steel web and a soft synthetic resin) to immersion in a plating liquid in the same manner as in the ordinary chromium plating. In this case, the chromium coating layer can be attached onto the exposed portion alone of the main body made of the stainless steel web, without the portion of the soft synthetic resin being corroded by the plating liquid, with the consequence that the plated portion assumes the brightening color tone of chromium.

With a view to enabling those persons skilled in the art to readily put the present invention into practice, there will be given in the following the process steps of the method of manufacturing the molding for vehicles according to one embodiment of the present invention.

(1) Stainless steel web is used as the starting material and is shaped through a roll-forming machine into a predetermined cross-sectional shape. For example, the front and rear door moldings (as indicated by reference letters "A" and "D" in FIG. 8) are shaped in the form of substantially inversed "J" in its cross-sectional profile, and the sash moldings (as indicated by reference letters "B" and "E" in FIG. 8) are formed into a channel having an angled "C" shape.

Figure 1:
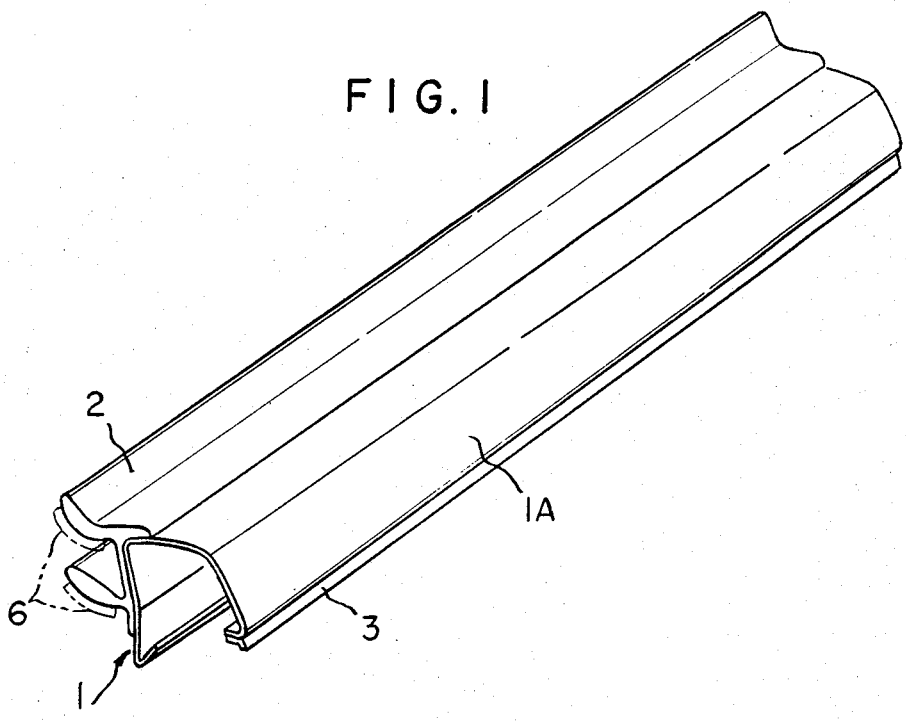
FIG. 1 is a perspective view showing a part of the door molding manufactured in accordance with the method of the present invention.
Figure 2:
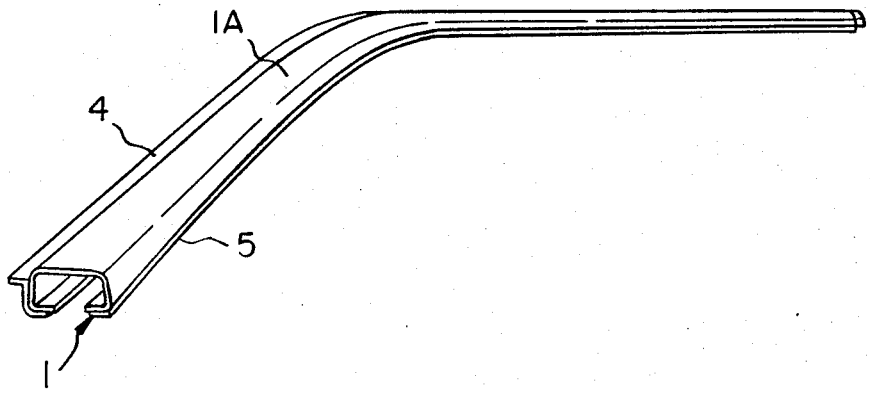
FIG. 2 is also a perspective view showing a part of the front sash molding manufactured in accordance with the method of the present invention.

(2) Subsequently, the abovementioned roll-formed main body obtained from a long web of the stainless steel, as the core material, is passed through an extrusion-molding machine so as to integrally form, in the case of the door molding, lip parts 2, 3 of the soft synthetic resin on the rear surface part and the lower edge part of the front surface side of the main body 1, as shown in FIG. 1, and to integrally form, in the case of the sash molding, a lip part 4 or a cushion part 5, as shown in FIG. 2.

(3) Both door moldings and sash moldings are then cut into a predetermined length. In the case of the front sash molding, it is further bent, as shown in FIG. 2, by passing it through a bender.

(4) The composite shaped article, which is made up of the main body 1 of stainless steel web and the integrally provided soft synthetic resin members 2, 3 (FIG. 1); 4, 5 (FIG. 2), is subjected to chromium-plating in the same process steps as in ordinary stainless steel articles. In this case, there is no particular necessity for considering the attachment of the plate-coating on the inner surface of the main body 1. Giving one example, the plating process may be done by the following sequential steps: defattening by immersion of the material to be plated; anodic electrolysis; acid electrolysis; nickel strike plating;luster nickel plating; and chromium-plating whereby the coating layer of chromium is attached onto the exposed portion 1A on the outer surface side of the main body 1.

(5) Thereafter, flocking is effected on the rear surface portion of the lip part 2 of the doormolding, which comes into contact with the window pane. In this case, it should be noted that, if the chromium-plating is effected after the flocking, the flocking material and the adhesive material for the flocking should inevitably be corroded by the plating liquid.

(6) Finally, depending on necessity, an end cap is formed integrally with the molding.

Figure 3:
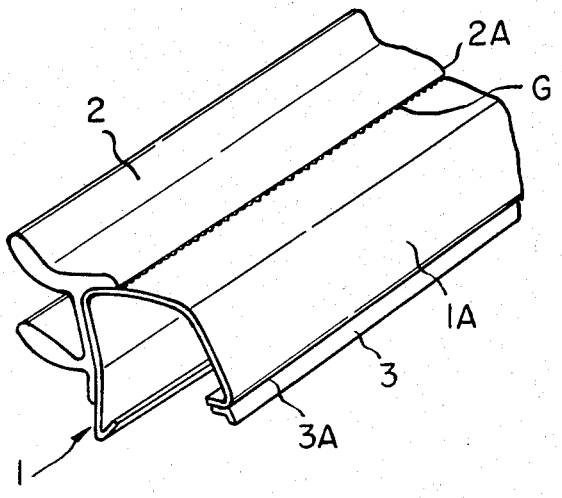
FIG. 3 is a perspective view of a part of the door molding, showing a state of the coated layer of chromium assuming a jagged form along the parting portion of its lip part.
Figure 4:
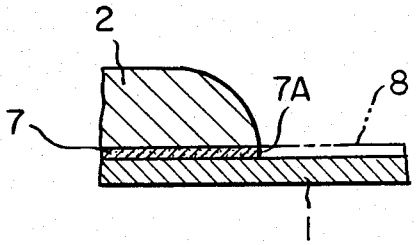
FIG. 4 is an enlarged cross-sectional view in the vicinity of the edge of the lip part.

Upon completion of the abovementioned plating treatment, from time to time, the edge of the chromium-plated layer assumes finely jagged form G, as shown in FIG. 3, along the parting portion 2A of the lip part 2 made of the soft synthetic resin. The reason for such jagging is that, as shown in FIG. 4, the edge portion 7A of the adhesive layer 7, which has been applied on the surface of the main body 1 of the stainless steel web, along the width for forming the lip part, for securing adhesion of the lip part 2 of the soft synthetic resin at the time of the extrusion-molding, is corroded by the plating liquid and becomes roughened.

It also seems that, at the groove part along the parting portion 2A. exchange of the plating liquid is not sufficient, and in addition, air-trapping (attaching of air foams) readily occurs to thereby create a portion where the plating liquid cannot be brought into contact with the parting portion. This phenomenon becomes conspicuous as the plate-coating increases its thickness.

As the measures for eliminating such phenomenon, the present invention according to its preferred example is so constructed that, as shown in FIG. 5, the edge of the adhesive layer 7, placed on the surface of the main body 1 of the stainless steel web, is set back slightly inside (about 0.5 mm) from the parting portion 2A of the lip part 2 of the soft synthetic resin so that the edge of the adhesive layer 7 may be covered with the lip part 2 of the soft synthetic resin at the time of the extrusion-molding.

Then, during the water-cooled sizing, following the extrusion-molding, the lip part 2 of the soft synthetic resin to some extent is separated from main body 1, as shown in FIG. 6, and a small clearance S is created between the lip part 2 and the main body 1 and the problem of the roughened edge is overcome.

In this state, when the plating operation is conducted, the edge of the chromium-plated layer 8, which was liable to be jagged in the conventional method, is hidden in the abovementioned clearance S to become substantially unviewable from outside.

The same phenomenon of jagging is seen in chromium-plated coating formed along the parting portion 3A of the lip part 3 of the soft synthetic resin provided on and along the lower edge of the main body 1 of the stainless steel web. However, because such roughened edge is situated beneath the lower surface of the main body 1, it cannot be seen from the outside. Accordingly, there is no particular necessity for taking the preventive measures, as mentioned in the foregoing. With the sash molding, the same measures may be taken on the edge of the abovementioned plate-coating, if need be.

Since the method for manufacturing the molding for vehicles, according to the present invention, is to attach the plate-coating of chromium on the exposed portion of the main body of stainless steel web, which constitutes the outer surface when the molding is mounted on the vehicle body, the chromium-plating can be readily effected on the required portions of the molding without necessity for any particular treatment. Hence, it is possible to obtain the molding having the brightening color tone which gives a sensation of high quality in comparison with the brightening property of the stainless steel.

It is also feasible that the main body of the molding is formed of ordinary steel web, and then the edge member, protruded member, etc. of a soft synthetic resin are formed onto this main body by the extrusion-molding, after which the chromium-coating can be attached onto the exposed portion of the main body by the plating operation. In this case, for the perfect corrosion-resistant property of the main body of the steel web, it is required that the chromium-coating be sufficiently adhered even onto the rear surface of the main body, on account of which the plating operation becomes troublesome, and the plating apparatus becomes complicated, hence increase in cost for its manufacture.

According to the present invention, however, because the stainless steel web is used for the main body of the molding, sufficient corrosion-resistant property can be secured. Hence no necessity arises for adherence of the chromium-coaling on the rear surface of the main body, so that the plating operation becomes simple and easy.

Further, when the molding, which is obtained by the abovementioned method, with the stainless steel web as the main body, is combined with other chromium-plated parts, the color tone of the brightening surface portion of the molding becomes coincident with other chromium-plated parts to look highly attractive.

Although, in the foregoing, the present invention has been described in specific details with reference to its preferred embodiment, it should be understood that the invention is not limited to this embodiment alone, but any changes and modifications may be done by those persons skilled in the art without departing from the spirit and scope of the invention as recited in the appended claims.

What is claimed is:

1. A method for manufacturing a molding for vehicles, which comprises the steps of: forming a stainless steel web into a main body of a predetermined cross-section for said molding; then attaching on said main body, in a longitudinal direction of said main body with an adhesive and with a portion of said main body projecting therefrom, members of soft synthetic resin formed by extrusion-molding, said resin members extending beyond a longitudinal edge of said adhesive; and subjecting said main body and said members to chromium-plating such that a coating layer of chromium is adhered onto the exposed surface of said projecting portion of said stainless steel main body, which constitutes its outside when said molding is mounted on the vehicle body.

* * * * *